US010968588B2

(12) United States Patent
Brewster, Jr.

(10) Patent No.: US 10,968,588 B2
(45) Date of Patent: Apr. 6, 2021

(54) METHOD AND APPARATUS FOR FIELD FABRICATION OF SOCKED PERFORATED DRAINS

(71) Applicant: James Franklin Brewster, Jr., Greensboro, NC (US)

(72) Inventor: James Franklin Brewster, Jr., Greensboro, NC (US)

(73) Assignee: Keller North America, Inc., Hanover, MD (US)

( * ) Notice: Subject to any disclaimer, the term of this patent is extended or adjusted under 35 U.S.C. 154(b) by 0 days.

(21) Appl. No.: 15/999,449

(22) Filed: Aug. 20, 2018

(65) Prior Publication Data

US 2019/0211523 A1 Jul. 11, 2019

Related U.S. Application Data

(60) Provisional application No. 62/615,707, filed on Jan. 10, 2018.

(51) Int. Cl.

| | |
|---|---|
| ***B65H 54/00*** | (2006.01) |
| ***E03F 1/00*** | (2006.01) |
| ***B65H 49/28*** | (2006.01) |
| ***E02B 11/00*** | (2006.01) |
| ***B65H 49/30*** | (2006.01) |
| ***E02B 11/02*** | (2006.01) |
| ***B65H 59/04*** | (2006.01) |

(52) U.S. Cl.

CPC ..... *E02B 11/005* (2013.01); *B65H 49/28* (2013.01); *B65H 49/305* (2013.01); *B65H 54/00* (2013.01); *B65H 59/04* (2013.01); *E02B 11/02* (2013.01); *E03F 1/00* (2013.01); *B65H 2701/33* (2013.01)

(58) Field of Classification Search

CPC ..... B65H 49/305; B65H 59/04; B65H 49/28; B65H 54/00; B65H 2701/33; B65H 75/02; B65H 49/30; E02B 11/02; E03F 1/00; B65D 85/67; G11B 23/00

USPC ..... 29/819; 206/395

See application file for complete search history.

(56) References Cited

U.S. PATENT DOCUMENTS

| | | | | |
|---|---|---|---|---|
| 5,820,296 | A | 10/1998 | Goughnour | |
| 6,461,078 | B1 | 10/2002 | Presby | |
| 6,846,130 | B2 | 1/2005 | Goughnour | |
| 10,179,981 | B2 * | 1/2019 | Groeneweg | E01F 15/148 |
| 2005/0109870 | A1 * | 5/2005 | Krise | B60P 3/00 242/557 |
| 2006/0283001 | A1 * | 12/2006 | Bussey, Jr. | E02B 11/00 29/429 |
| 2009/0308769 | A1 * | 12/2009 | Mutter | E02B 11/005 206/395 |

(Continued)

*Primary Examiner* — Lawrence Averick

(74) *Attorney, Agent, or Firm* — Royal W. Craig; Gordon Feinblatt LLC

(57) ABSTRACT

A mobile fabrication solution for onsite assemblage of earth drains for ground stabilization that includes a despooling carousel for uncoiling corrugated tubing from a stock supply, and for feeding the stock tubing into an extrusion head unit. The head unit contains counter-rotating wheels that grip and drive the tubing out through a collet into a filter sock and into a collection trough. One end of a stock supply of fabric filter sock is attached to the collet exteriorly of the head unit to the collet and is unrolled along the trough. When the corrugated tubing is ejected it fills the sock within the trough and may be cut to the desired length onsite, eliminating waste.

18 Claims, 6 Drawing Sheets

(56) References Cited

U.S. PATENT DOCUMENTS

| | | | | |
|---|---|---|---|---|
| 2013/0315675 | A1* | 11/2013 | Pajak | F16L 1/11 405/184 |
| 2015/0158692 | A1* | 6/2015 | Reynolds | B65H 49/34 242/390.2 |
| 2017/0248253 | A1 | 5/2017 | Van Hoose et al. | |
| 2018/0079400 | A1* | 3/2018 | Crossman | B60T 13/741 |
| 2018/0282109 | A1* | 10/2018 | Colleoni | H02G 1/06 |

* cited by examiner

METHOD AND APPARATUS FOR FIELD FABRICATION OF SOCKED PERFORATED DRAINS

CROSS-REFERENCE TO RELATED APPLICATION(S)

The present application derives priority from U.S. provisional application Ser. No. 62/615,707 filed 10 Jan. 2018.

BACKGROUND OF THE INVENTION

1. Field of the Invention

The present invention relates to geosynthetics and more specifically to a portable field method and device for the fabrication/assembling of earthquake drains onsite.

2. Description of the Background

The ground improvement and deep foundation industries rely on various types of drainage systems. For example, one of the most destructive effects of earthquakes is their effect on deposits of saturated, loose, fine sand or silty-sand, causing a phenomenon known as liquefaction. When liquefaction occurs, the soil mass loses all shear strength and acts temporarily as a liquid. Such temporary loss of shear strength can have catastrophic effects on earthworks or structures founded on these deposits. Major landslides, lateral movement of bridge supports, settling or tilting of buildings, and failure of waterfront structures may result. There are several approaches to ground improvement to avoid liquefaction, including densifying, compacting and/or draining soils in-place to increase bearing capacities and shear strengths, reduce settlements, stabilize slopes and to mitigate liquefaction potential. In fact, a combination of drainage and densification is the most conservative approach to liquefaction mitigation.

Earthquake drains are large-flow capacity synthetic vertical drains, installed with a vibrating mandrel into loose sands and silty sands. The vibratory installation achieves some densification of the soils, increasing their cyclic shear resistance, while the drain provides a path for the rapid dissipation of earthquake-generated excess pore pressures. Earthquake drains typically comprise corrugated polyethylene pipe with slits inside the corrugations, and wrapped with a "sock" comprising a geotextile filter fabric. Typical nominal diameters range from 75 mm-200 mm (3.0 in-8.0 in). Earthquake drains can be installed to depths up to and over 25 m (85 ft).

An exemplary early patent for corrugated plastic pipe perforated or slotted and wrapped in a geofabric for liquefaction mitigation is U.S. Pat. No. 6,461,078 to Presby issued Oct. 8, 2002. More recent examples include U.S. Pat. No. 6,846,130 to Goughnour (Nilex—HB Wick Drains) issued Jan. 25, 2005, which shows a method and apparatus for enhancement of prefabricated earth drains in which the soil surrounding the earth drain is hydraulically fractured either while the drain is in place or while the earth drain is being installed. The '130 patent provides an excellent history of earth drains including the corrugated plastic pipe perforated or slotted and wrapped in a geofabric for liquefaction mitigation. Similarly, U.S. Pat. No. 5,820,296 to Goughnour (Nilex—HB Wick Drains) issued Oct. 13, 1998 shows a method of making a prefabricated wick drain by extruding elongated sheets of flexible plastic with horizontal corrugations and surrounding said corrugated core sheet with filter fabric.

Today several manufacturers currently make earthquake drains at their factories and ship them to site. For example, United States Patent Application 20170248253 by Van Hoose et al. (Advanced Drainage Systems Inc.) filed May 15, 2017 discloses a process-line application of an outer wrap to a corrugated pipe. As described at para. [0042] uncut corrugated pipe may continue directly to an outer wrap die assembly that applies plastic outer wrap in the pipe production line based on real time calculation of flow rate for applying the wrap.

However, due to unforeseeable variability in installation length requirements, pre-manufactured purchase is not very cost effective. It would be far more convenient and economical to provide a mobile fabrication solution for use onsite that facilitates application of a sock onto corrugated tubing and cutting to the desired length onsite, eliminating waste.

SUMMARY OF THE INVENTION

It is, therefore, an object of the present invention to provide a mobile fabrication solution for use onsite that facilitates the manufacture of an earthquake drain from stock perforated and corrugated tubing, including application of a filter sock onto the perforated/corrugated tubing and cutting to the desired length onsite, eliminating waste.

It is a more generalized object to provide a mechanized device for inserting a flexible fabric cover onto corrugated tubing of any length.

According to the present invention, the above-described and other objects are accomplished by providing a mobile fabrication solution for use onsite that includes a despooling carousel for uncoiling corrugated tubing from a stock supply, for controllably extruding it into a filter sock, and into a collection trough were the desired length of socked tubing can be cut and anchored on an as-needed basis. The mobile fabrication solution is trailer-mounted, including the carousel which feeds stock tubing into an extrusion head unit. The head unit contains counter-rotating wheels that grip and drive the tubing out through a collet into the filter sock and into a collection trough. One end of a stock supply of fabric filter sock is attached to the collet exteriorly of the head unit to the collet and is unrolled along the trough. When the corrugated tubing is ejected it fills the sock within the trough and may be cut to the desired length onsite, eliminating material waste.

BRIEF DESCRIPTION OF THE DRAWINGS

Other objects, features, and advantages of the present invention will become more apparent from the following detailed description of the preferred embodiment and certain modifications thereof, in which.

DETAILED DESCRIPTION OF THE PREFERRED EMBODIMENTS

Figure 1:
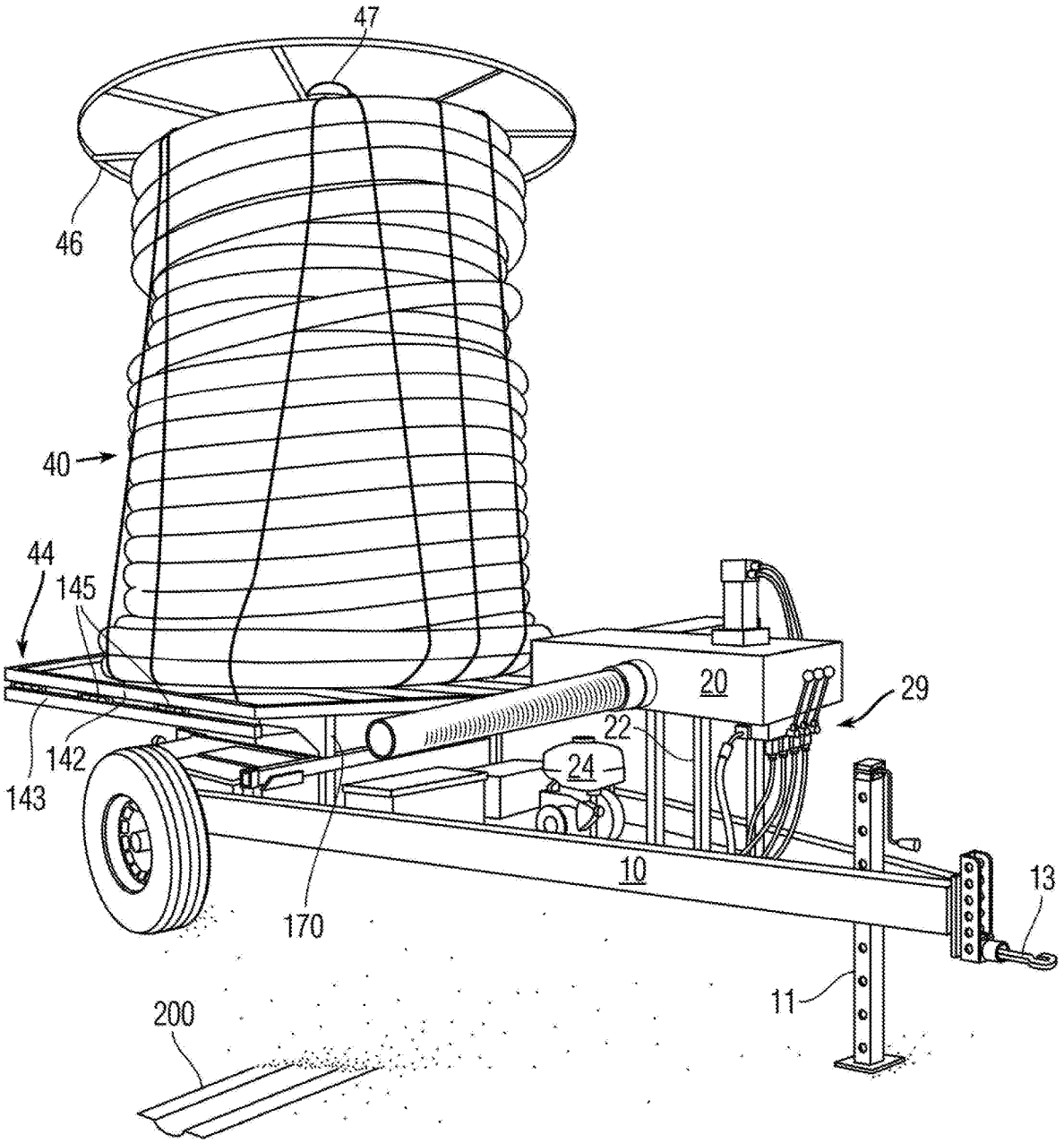
FIG. 1 is a perspective side view of a mobile fabrication apparatus according to an embodiment of the invention.
Figure 2:
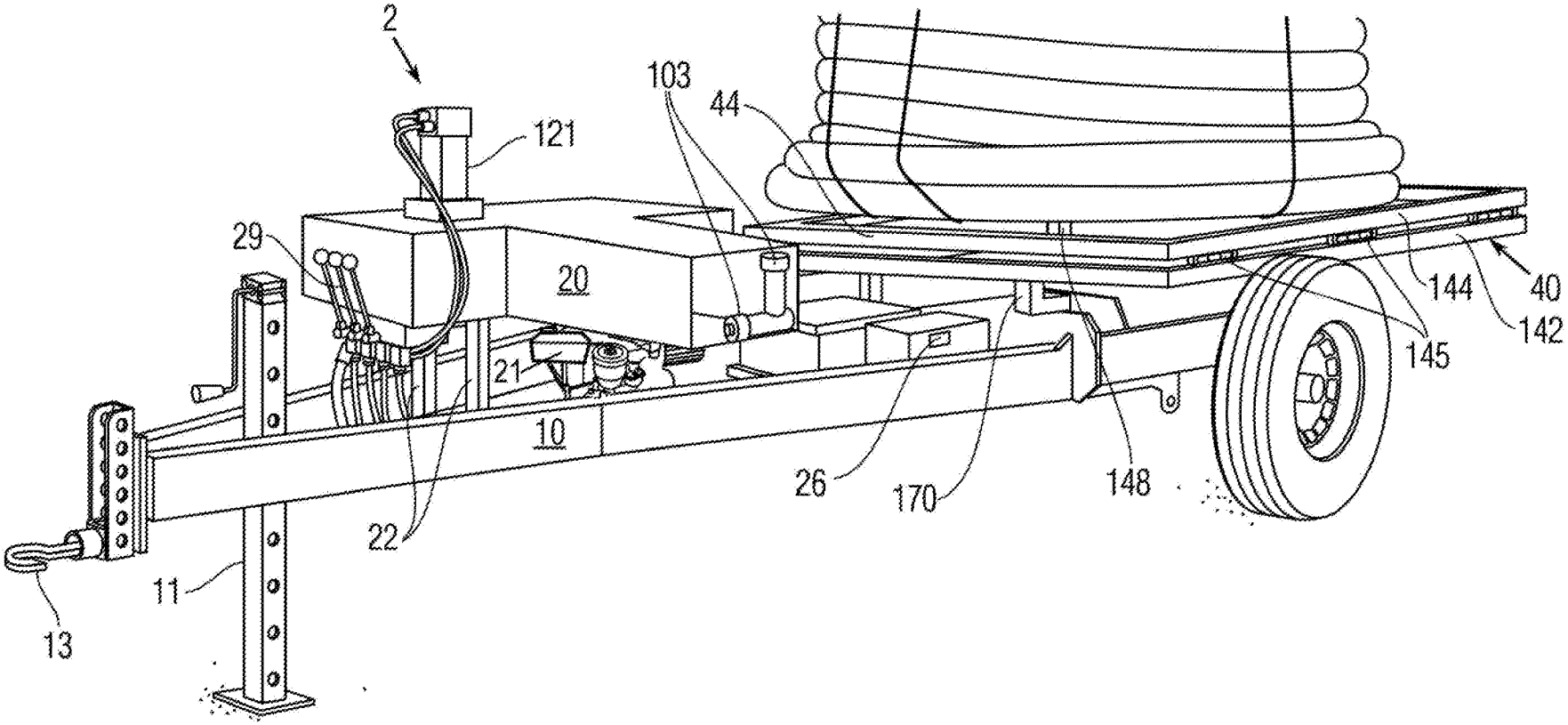
FIG. 2 is a perspective side view of the mobile fabrication apparatus of FIG. 1 loaded with corrugated tubing and ready for onsite operation.

With combined reference to FIGS. 1-2 a mobile fabrication apparatus 2 according to an embodiment of the invention comprises a heavy duty single-axle utility trailer frame 10 with expanded A-frame and short bed, and conventional tow hitch 13 and jack stand 11. The illustrated trailer frame 10 is a 5'×10' single axle steel commercial-grade frame with seven foot A-frame defining an elongate triangular A-section and a trailing three foot rectangular bed section, both sections reinforced by a plurality of cross-struts for mounting equipment. For present purposes an Agri Drain™ Maxi Stringer trailer 10 was modified as needed.

An extrusion head unit 20 is mounted above the A-frame of trailer 10 on elevated legs 22 which provide approximately 18" of vertical offset, and a horizontal-shaft gas engine 24 is attached within the A-frame of trailer 10 in the clearance provided by elevated legs 22. A suitable engine is a Honda® Horizontal OHV, 270 cc, GX Series 8 hp engine. The engine 24 directly drives a hydraulic pump 26, the pump being matched to the engine 24. Given the aforementioned engine 24 a suitable pump 26 is a concentric 11 GPM, Haldex® concentric single-stage pump capable of delivering constant flow at 900 PSI max pressure. The input of the pump 26 is in fluid connection to a relatively small two gallon hydraulic reservoir 27. The output of pump 26 is preferably pressure regulated and runs to a 2-spool directional control valve 29 rated similarly, e.g., 900 PSI, a variety of which are commercially available from, for example, NorTrac®. The fluid outputs of control valve 29 are in fluid connection with a tilt platform 70 (to be described) mounted on the rectangular bed of trailer 10. A despooling carousel 40 is rotatably mounted atop tilt platform 70 which provides approximately 18" of vertical offset such that the despooling carousel 40 is approximately the same height as head unit 20. The carousel 40 is free-spinning with a brake mechanism and designed to despool a stock supply of corrugated tubing into the head unit 20 as shown in FIG. 2.

Contrasting FIGS. 1 and 2 it can be seen that carousel 40 includes a folding bottom flange 44 and removable top flange 46 to spool/despool stock tubing. The sides of bottom flange 44 fold inward (FIG. 1) to minimize girth and preserve the towability of the trailer frame 10, yet lock in the outward unfolded position (FIG. 2) to form a larger circular lower support surface to support and smoothly despool tubing. More specifically, as seen in FIG. 2 bottom flange 44 is constructed of three discrete segments 142-144, inclusive of a center partially-spherical segment 142 and two opposing hemispherical segments 143, 144, the latter both pivotally attached to the center segment 142 and unfoldable to a circular bottom flange 44. The center partial-spherical segment 142 is formed from two lengths of curved angle iron joined at their ends to two flat parallel iron struts, and a latticework of inner reinforcing flat iron struts as shown. The two opposing hemispherical segments 143, 144 are both formed from a length of hemispherical angle iron joined at both ends to a flat iron strut, and a latticework of inner reinforcing flat iron struts as shown. The two opposing hemispherical segments 143, 144 are pivotally attached to the flat struts of the center spherical segment 142 by locking hinges 145 of the type that can be locked in angular position by a clamping handle attached to the hinge pin. This way, the two opposing hemispherical segments 143, 144 may be pivoted downward to a compact tow position or locked flat and planar with the center spherical segment 142 by locking hinges 145 for despooling.

As seen in FIG. 1 top flange 46 is constructed in a fixed wagon-wheel configuration of smaller diameter than the deployed bottom flange 44, e.g., of a surrounding spherical angle bracket and radial flat iron struts converging at the center. The top flange 46 is attached to the bottom flange 44 by a removable tubular pylon (obscured), and these components are secured together by a pylon cap 47. Thus, as seen in FIG. 1, the axle cap 47 may be unscrewed to allow for removal and stowage of the top flange 46 and pylon inside the tow vehicle during transport.

Figure 5:
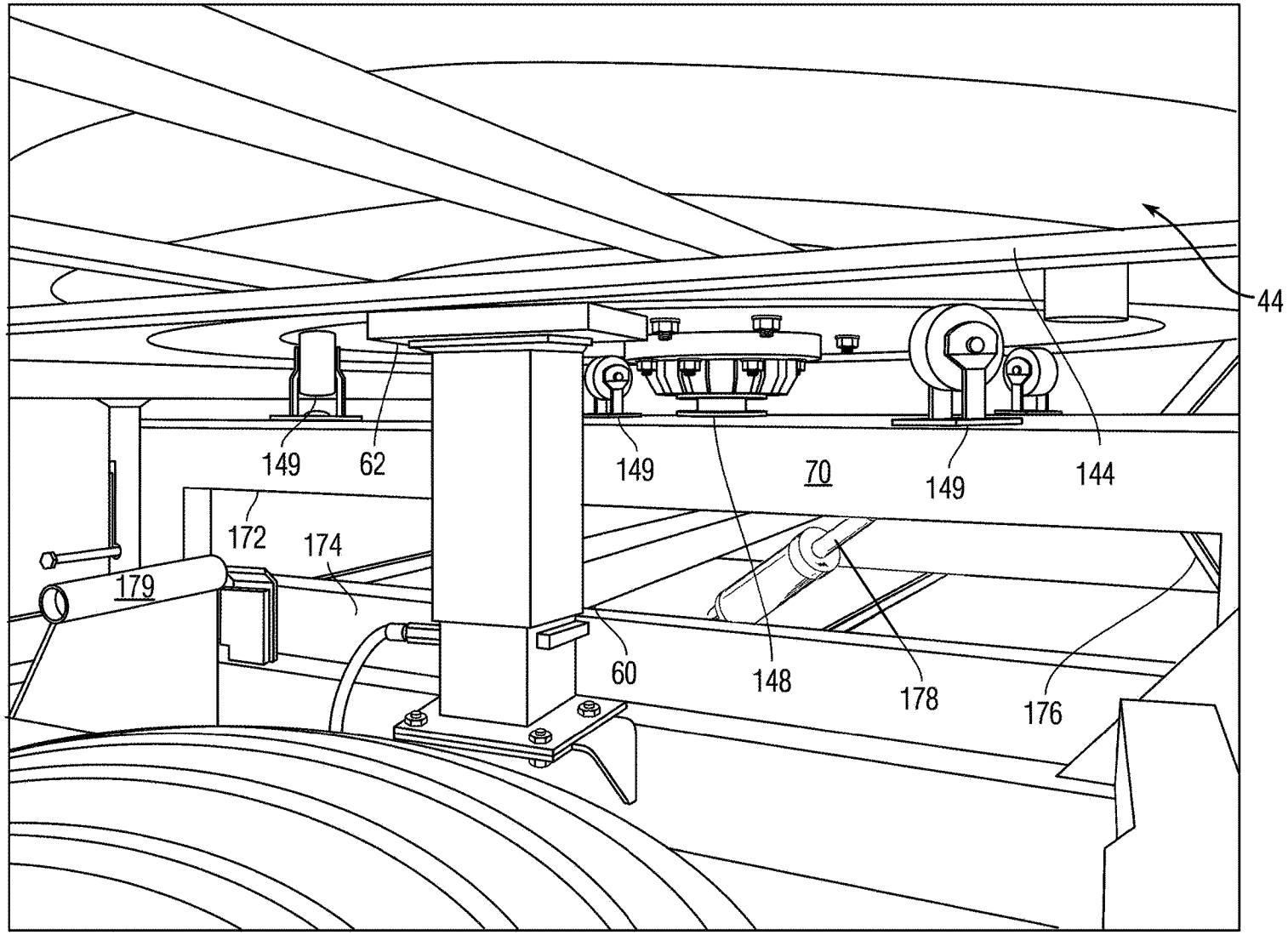
FIG. 5 is a perspective view of the carousel 40 from the underside.

As seen in FIG. 5 the bottom flange 44 is rotatably mounted on an upright axle/bearing combination 148 that is bolted to a tilt platform 170 (to be described) secured in the rectangular bed of axle utility trailer frame 10. A plurality of passive rubber rollers 149 are mounted on the elevated tilt platform 70 beneath the bottom flange 44 of despooling carousel 40 and in rolling engagement therewith, evenly-radially spaced from the axle/bearing 148 to bear against the underside of the bottom flange 44 as it spins, to provide lateral support thereto during despooling. The axle/bearing 148 is passive and free-spinning. However, the tilt angle of the carousel 40 is adjustable via tilt platform 70, powered by a hydraulic piston 178 connected to the hydraulic outputs of control valve 29. In this way, a single operator can control the tilt angle of carousel 40, adjusting the angle of the entire carousel 40 from horizontal rearward 90 degrees to vertical to facilitate loading and unloading of the spool of corrugated tubing. Moreover, the free-spinning carousel 40 allows despooling matched to the feed-through rate of tubing through extrusion head unit 20.

Figure 4:
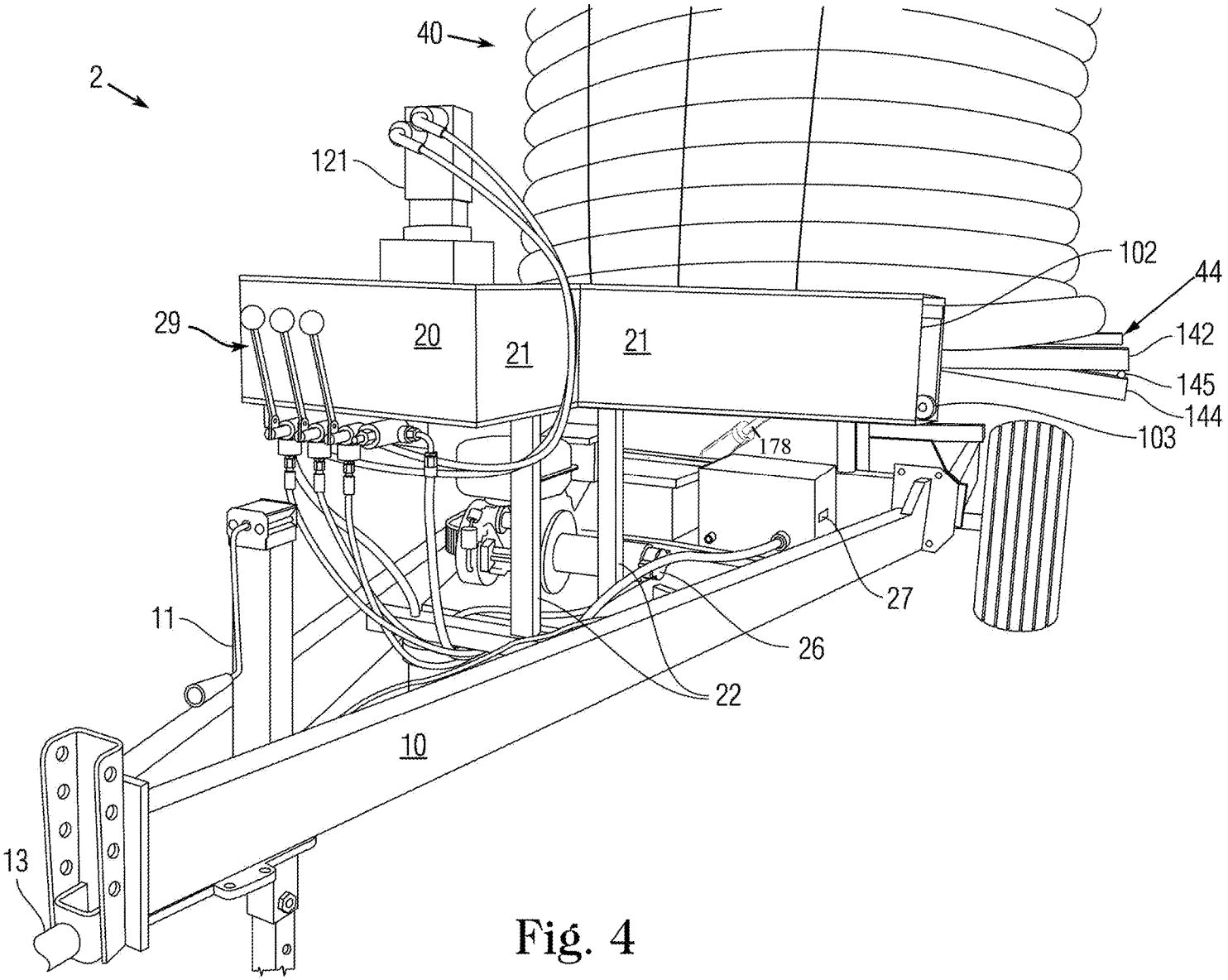
FIG. 4 is a close-up front view of the head unit 20 of the mobile fabrication apparatus of FIGS. 1-3.
Figure 6:
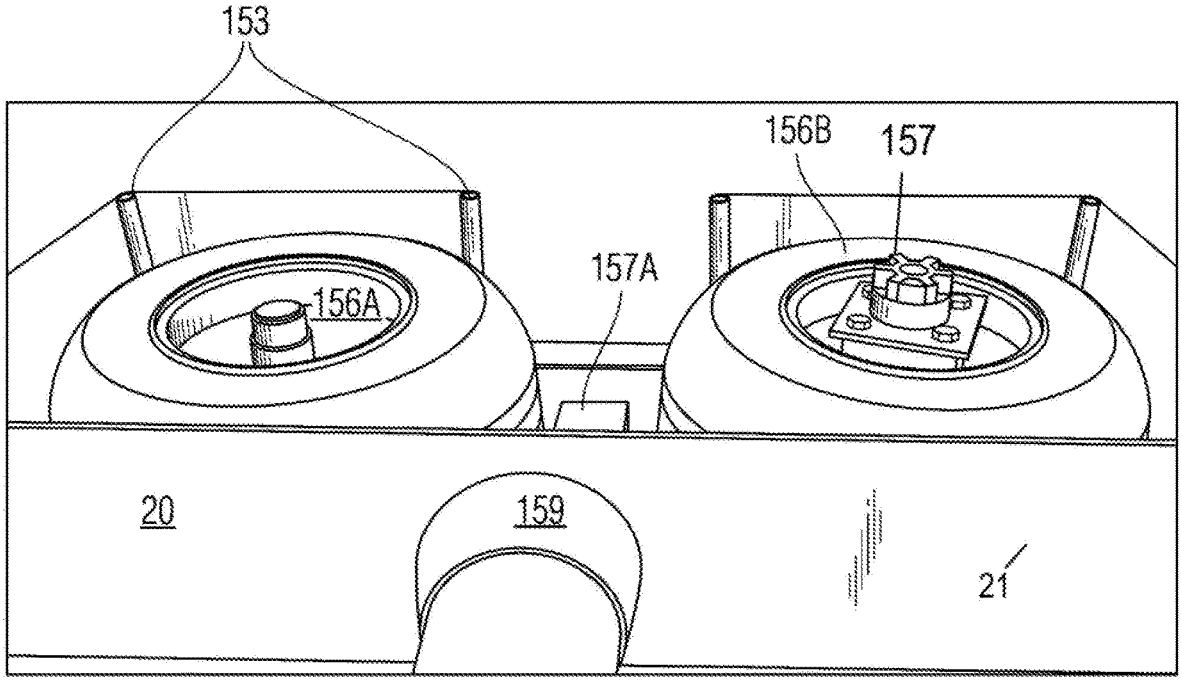
FIG. 6 illustrates the internal configuration of the head unit 20 with top housing section removed.

Referring now to FIG. 4 the extrusion head unit 20 further comprises a housing 21 (containing counter-rotating wheels 156A, 156B and hydraulic motor 121 to be described with regard to FIG. 6) with an input chute 102 leading transversely into the housing 21 through a sidelong aperture therein. The input chute 102 accepts corrugated tubing off carousel 40 and guides it into head unit 20. A brake mechanism is provided to apply braking force to the carousel 40 during despooling, if necessary, from the front of the unit 2. The brake mechanism comprises hydraulic reservoir 27 connected through a dedicated one of the control valves 29 (FIG. 1) to a hydraulic piston actuator 60 (see FIG. 5) mounted on the trailer frame 10 and extending a brake shoe 62 against the underside of platform 144. The brake shoe 62 is applied to the underside of carousel 40 to retard rotation.

FIG. 5 is a perspective view of the carousel 40 from the underside, showing a hydraulic piston actuator 60 mounted on the trailer frame 10 and extending a brake shoe 62 against the underside of platform 144. Otherwise the carousel 40 is free-spinning, the bottom flange 44 being rotatably mounted on a heavy duty sealed axle/bearing combination 148 that is bolted to the tilt platform 70 which is in turn attached to the bed of axle utility trailer frame 10. FIG. 5 also shows one of the pair of passive rollers 149 mounted atop the elevated platform 41 on opposite sides of the axle/bearing 148 to bear against the underside of the bottom flange 44 as it spins, to provide lateral support thereto during despooling.

The tilt platform 70 allows the operator from control valve 29 (FIG. 1) to tilt the entire carousel 40 from horizontal rearward 90 degrees to vertical to facilitate loading and unloading of the spool of corrugated tubing. Toward this end, the tilt platform 70 comprises an upper rectangular frame 172 pivotally attached at one end by axle 176 to an end of a conforming lower rectangular frame 174 for clamshell articulation. A hydraulic cylinder 178 is connected there between and actuated from control valve 29 to open the upper rectangular frame 172 from lower rectangular frame 174, tilting the former rearward. A full 90 degree rearward tilt is possible. Note additionally the presence of a push-pin keyed locking assembly 179 at the other end to couple/uncouple upper rectangular frame 172 from lower rectangular frame 174 and lock it at any of a number of discrete angles, thereby preventing inadvertent tilt and injury during use.

Figure 7:
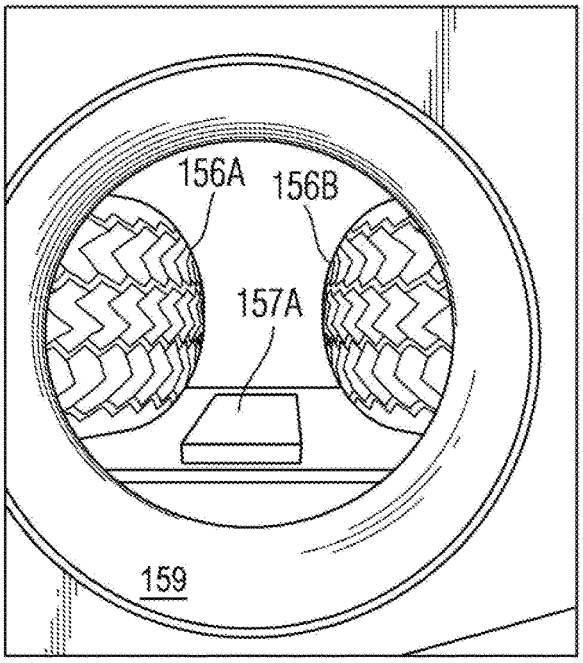
FIG. 7 is a close-up end view of the chute 102 into head unit 20 with an optional guide plate 157A.

FIG. 6 illustrates an exemplary internal configuration of the head unit 20 with housing 21 removed. The internal configuration of the head unit 20 comprises a support framework containing counter-rotating wheels 156A, 156B, the active wheel 156B including a top-mounted gear 157 for engagement with the hydraulic motor 121 mounted on head unit 20 (FIG. 2). Referring back to FIGS. 1-2 with housing 21 installed the input chute 102 leads transversely therein between wheels 156A, 156B. The input chute 102 accepts corrugated tubing off carousel 40 and guides it into head unit 20. With reference again to FIG. 6 the framework for head unit 20 further comprises two cooperating sections (bottom section shown) separated by a plurality of spacer posts 153 bolted there between. The hydraulic motor 121 is attached upwardly to the top section (see FIG. 2) and is directly engaged to the gear 157 of the active drive wheel 156B, the opposing wheel 156A being passive but likewise rotatably attached between the two cooperating housing sections of head unit 20. The active drive wheel 156A is spaced apart from passive wheel 156B so as to frictionally engage the corrugated pipe there between. Both of drive wheels 156A, 156B are preferably commercially-available wheels bearing turf tires (R3 turf) which grip the corrugations of the tubing yet distribute weight evenly without making impressions. As seen in FIG. 7, an optional pair of diametric slide plates 157 (or guide rollers or the like) may be mounted inside chute 102 between the drive wheels 156A, 156B above and below (one being shown in FIG. 7) to reduce the risk of the tubing corrugations catching inside head unit 20 and to improve traction of the drive wheels 156A, 156B.

To further facilitate guidance of corrugated tubing off carousel 40 and into head unit 20, as seen in FIGS. 2 and 4, chute 102 may also include one or more optional roller(s) 103 at its mouth. In the illustrated embodiment one such roller 103 is mounted horizontally below chute 102 and one vertically along the inner edge of chute 102 at its mouth to guide the drain as it despools around. In addition, the innermost wall of chute 102 is preferably angled or contoured to accommodate the bend in tubing as it despools from carousel 40. Rollers 103 may be commercially-available marine rollers as shown. However, it has been found in practice that the diametric slide plates 157 of FIG. 7 give the active wheel 156A optimal traction and reduces the need for lateral guide roller(s) 103 as in FIGS. 2 and 4, and so roller(s) 103 are optional with slide plates 157.

Referring back to FIG. 6, the two drive wheels 156A, 156B intake the corrugated tubing through extrusion head unit 20 and eject it outward through an aperture in the housing and through a collet 159 attached exteriorly of the housing. Collet 159 is a tapered funnel held in place by U-clamps or the like, to which one end of stock filter sock material can be exteriorly attached. Once so attached, the corrugated tubing is driven by drive wheels 156A, 156B through the head unit 20 under control of control valve 29, through the collet 159 into the filter sock for onsite fabrication.

Referring back to FIG. 1, an elongate chute or trough 200 is preferably provided for collection and measurement of the now-socked earthquake drain. As the socked corrugated tubing is ejected from head unit 20 it is directed along chute 200, which is preferably an approximately 100 foot chute constructed on wood or the like, and demarcated with length indicia. This way, a second operator can accumulate the socked tubing inside chute 200, cut to length onsite in real time, and install a proper anchor on the end for use. The entire fabrication process takes literally seconds for each length of tube.

Figure 8:
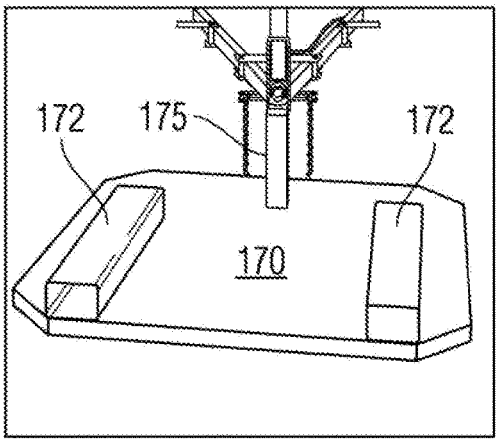
FIG. 8 illustrates weighting plate 170 to offset the weight of the stock tubing on carousel 40 and to provide transport via fork lift.

FIG. 8 illustrates one additional helpful feature which is a weighting plate 170 provided to offset the weight of the stock tubing once loaded on carousel 40. The weighting plate 170 is preferably a thick steel rectangular section of steel plate with opposing fork lift slots 172 for carrying by forklift, and weighing approximately 200 lbs for proper offset. A vertical mounting collar 175 is welded along one edge of plate 170 for attachment to the jack stand of the trailer frame 10. In future versions it is envisioned that modifications to the length of the frame and/or placement of axles may balance the mobile fabrication apparatus 2 without the need for a hitch-mounted counterweight or attachment to a truck, and so the intention is to minimize, eliminate or replace weighting plate 170 with a simple jack stand or the like.

Figure 3:
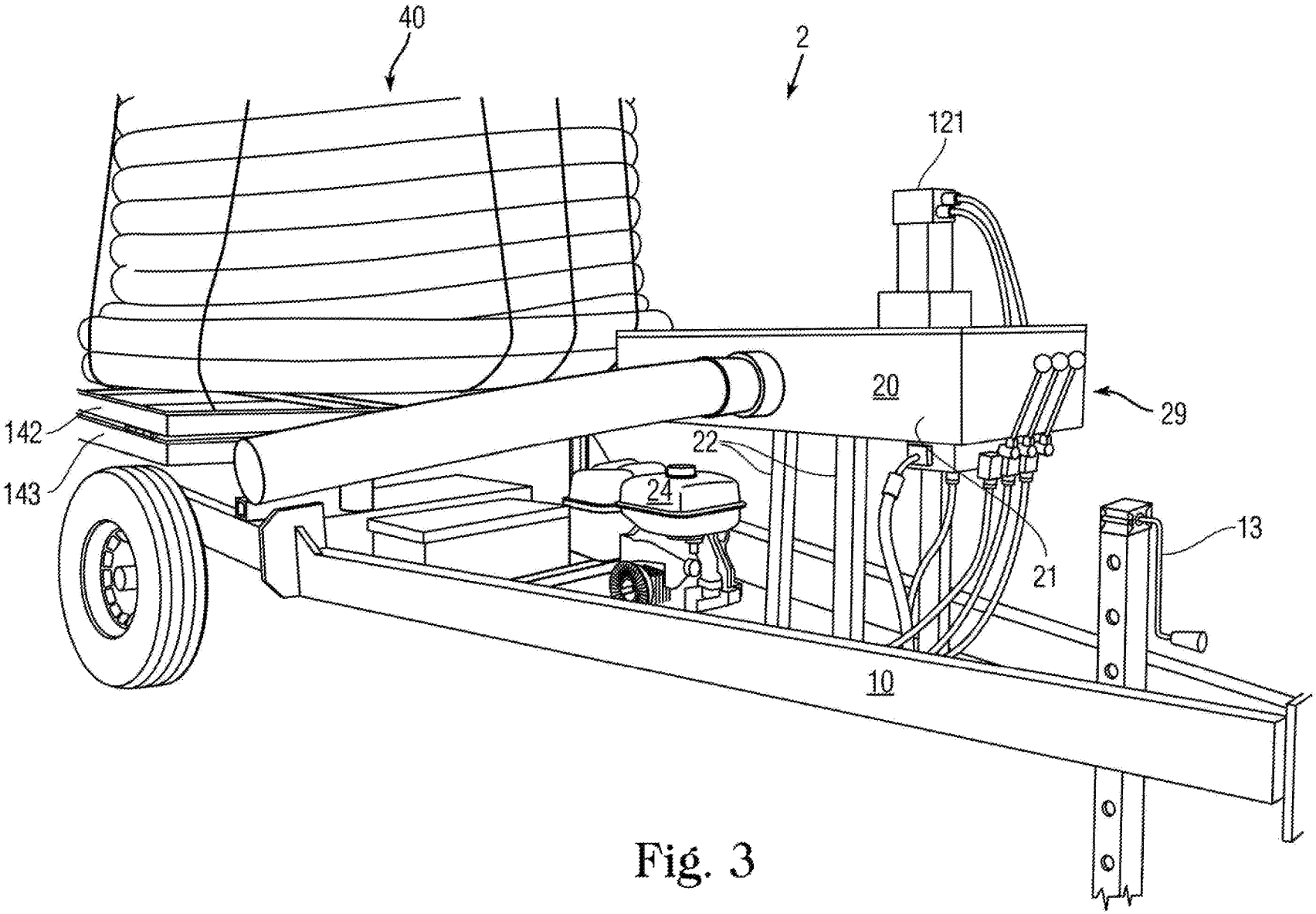
FIG. 3 is a close-up perspective view of the head unit 20 of the mobile fabrication apparatus of FIGS. 1-2.

In use of the mobile fabrication apparatus 2, two operators should be present. The trailer frame 10 is towed into place and unhitched, weighting plate 170 is attached, carousel 40 deployed (end sections folded up and upper flange and central post attached). The gas engine 24 is started and the tilt platform 170 is titled rearward via control valve 29 to facilitate loading of the spool of corrugated tubing. A supply of corrugated tubing is loaded onto carousel, the tilt platform 170 is titled back and collection chute 200 is positioned diagonal to head unit 20 at its outlet. One end of tubing is manually despooled from carousel and fed into the wheels of head unit 20. The operator attends to the control valves 29, using one to control the speed and direction of automated despooling through head unit 20, one to control the tilt of the carousel for loading and unloading, and one to brake the carousel 40. Viewing the control valves 29 from left to right in FIG. 3, the leftmost control 29 controls forward/reverse pipe feed, the controls forward/reverse tilt of the carousel 40 for unloading/loading, and the rightmost controls the brake 60 applied to the carousel 40. The operator attaches one end of stock filter sock material to collet 159, and lies a desired length in chute 200. As the corrugated tubing is ejected from head unit 20 it ejects through the collet 159 into the sock and along chute 200. When the filter sock is filled the operator stops despooling/ejecting. The operator cuts the filter sock and corrugated tube to length, ties off one end of sock, and attaches an anchor to the other end so that it is ready for use. The entire process takes seconds and there is no wasted material.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. An apparatus for mobile fabrication of socked drains, comprising:

a wheeled trailer frame;

a despooling carousel rotatably mounted on the trailer frame and configured for despooling plastic tubing; and an extrusion head configured for extruding plastic tubing despooled from said carousel into a filter sock, said extrusion head comprising a pair of counter-rotating wheels for gripping and controllably extracting plastic tubing from said despooling carousel and extruding it between said pair of counter-rotating wheels into a filter sock.

2. The apparatus for mobile fabrication of socked perforated drain according to claim 1, further comprising a tilt platform mounted on said trailer frame, said despooling carousel being tiltably mounted on said tilt platform.

3. The apparatus for mobile fabrication of socked perforated drain according to claim 2, wherein said despooling carousel rotates about an axis of rotation and said tilt platform attached to said trailer platform is configured for tilting said axis of rotation.

4. The apparatus for mobile fabrication of socked perforated drain according to claim 3, wherein said tilt platform comprises an upper frame pivotally attached at one end by axle to one end of a conforming lower frame for clamshell articulation.

5. The apparatus for mobile fabrication of socked perforated drain according to claim 4, wherein said tilt platform comprises a fluid piston attached between said upper and lower frames for tilting said tilt platform.

6. The apparatus for mobile fabrication of socked perforated drain according to claim 5, further comprising a fluid control valve in fluid communication with said piston controllably tilting said tilt platform.

7. The apparatus for mobile fabrication of socked perforated drain according to claim 6, further comprising an engine mounted on said trailer platform and a fluid pump coupled to said engine for supplying fluid to said control valve.

8. The apparatus for mobile fabrication of socked perforated drain according to claim 1, further comprising a collection trough for collecting plastic tubing after despooling and extruding into a filter sock.

9. The apparatus for mobile fabrication of socked perforated drain according to claim 8, wherein said collection trough comprises length indicia for cutting said socked tubing to length.

10. The apparatus for mobile fabrication of socked perforated drain according to claim 1, wherein said despooling carousel comprises a bottom flange, and a removable top flange offset from said bottom flange.

11. The apparatus for mobile fabrication of socked perforated drain according to claim 10, wherein said bottom flange comprises two folding sides.

12. The apparatus for mobile fabrication of socked perforated drain according to claim 1, further comprising a brake mechanism for applying braking force to the despooling carousel.

13. The apparatus for mobile fabrication of socked perforated drain according to claim 12, wherein said brake mechanism comprises a brake shoe engageable to the underside of said despooling carousel to inhibit rotation.

14. The apparatus for mobile fabrication of socked perforated drain according to claim 1, wherein said extrusion head unit further comprises a motor.

15. The apparatus for mobile fabrication of socked perforated drain according to claim 12, further comprising a pair of guides mounted diametric to said pair of wheels.

16. The apparatus for mobile fabrication of socked perforated drain according to claim 1, wherein said motor is configured for driving one of said pair of counter-rotating wheels.

17. The apparatus for mobile fabrication of socked perforated drain according to claim 1, further comprising a weight attachable to said trailer platform opposite said despooling carousel to offset weight of plastic tubing loaded on said despooling carousel.

18. The apparatus for mobile fabrication of socked perforated drain according to claim 17, wherein said motor is a hydraulic motor.

* * * * *